United States Patent [19]

Spindt

[11] Patent Number: 4,874,981

[45] Date of Patent: Oct. 17, 1989

[54] AUTOMATICALLY FOCUSING FIELD EMISSION ELECTRODE

[75] Inventor: Charles A. Spindt, Menlo Park, Calif.

[73] Assignee: SRI International, Menlo Park, Calif.

[21] Appl. No.: 192,341

[22] Filed: May 10, 1988

[51] Int. Cl.[4] ..... H01J 1/30; H01J 9/02

[52] U.S. Cl. ..... 313/309; 313/308; 313/336; 313/351; 156/644; 427/77; 445/24; 445/46

[58] Field of Search ..... 313/309, 336, 351, 414, 313/497, 447, 308, 310; 445/24, 35, 46, 49, 50; 156/644; 427/77

[56] References Cited

U.S. PATENT DOCUMENTS

| | | | |
|---|---|---|---|
| 3,497,929 | 3/1970 | Shoulders et al. | 29/25.17 |
| 3,665,241 | 5/1972 | Spindt et al. | 313/351 |
| 3,735,186 | 5/1973 | Klopfer et al. | 313/346 R |
| 3,755,704 | 8/1973 | Spindt et al. | 313/309 |
| 3,789,471 | 2/1974 | Spindt et al. | 29/25.17 |
| 3,812,559 | 5/1974 | Spindt et al. | 29/25.18 |
| 3,921,022 | 11/1975 | Levine | 313/309 |
| 4,020,381 | 4/1977 | Oess et al. | 313/302 |
| 4,103,202 | 7/1978 | Finger et al. | 313/336 |
| 4,141,405 | 2/1979 | Spindt | 164/46 |
| 4,178,531 | 12/1979 | Alig | 313/409 |
| 4,498,952 | 2/1985 | Christensen | 156/643 |
| 4,721,885 | 1/1988 | Brodie | 313/576 |

OTHER PUBLICATIONS

Spindt et al.; "Recent Progress in Low-Voltage Field Emission Cathode Development"; Dec. 1984, Journal de Physique, Compendium C9, Supplement to vol. 45, No. 12, pp. 269-278.

*Primary Examiner*—Kenneth Wieder

*Attorney, Agent, or Firm*—Cushman, Darby & Cushman

[57] ABSTRACT

Several embodiments of a thin film field emission cathode array are described which automatically shape the beams of emitted particles, without the addition of shaping or other electrode structure. A potential field pattern is established to control the trajectory of the emitted particles, by controlling the electromagnetic interaction of the conductive structures responsible for the particle emission.

21 Claims, 2 Drawing Sheets

AUTOMATICALLY FOCUSING FIELD EMISSION ELECTRODE

BACKGROUND OF THE INVENTION

The present invention relates to electrically charged particle emission structures. It more particularly relates to a method of generating such particles and controlling their initial trajectory, to a field emission structure for practicing the method, and to a method of constructing the same.

Cathode structures using electrically charged polarized particle emission principles now are being relatively widely used and investigated as field emission cathodes. Miniaturized thin film field emission cathode arrays (called by many "Spindt" cathodes in view of the contributions of the inventor of the subject matter hereof) have attributes which make them more suitable than thermal and other cold cathode arrangements for many uses. For example, they provide high emission current density for minimum voltage operation, and most designs have a relatively small geometric size in the direction of electron production. Field emission cathode arrays typically include an electrically conductive base structure from which small needle-like electron emitting tips project. A control electrode structure is spaced from the base adjacent the emitting tips, and a control voltage differential is established between the base and the control electrode to cause the desired emission of electrons from the tips. An electrical insulator generally is sandwiched between the base and the control electrode to prevent breakdown of the voltage differential and provide mechanical support for the control electrode.

The electron emitting tips are typically grouped on the base at discrete locations to provide a plurality of spaced-apart emissions sites, although in some instances a single emitting tip is used for each site. Both the control electrode and the insulator have apertures at the emitting sites to enable emission of electrons at such locations. U.S. Pat. Nos. 3,665,241; 3,755,704; 3,789,471; 3,812,559; and 4,141,405 (all of which name the present applicant as a sole or joint inventor) and the paper entitled "Recent Progress in Low-Voltage Field Emission Cathode Development" Journal de Physique, Supplement to Vol. 45, No. 12 (December 1984), provide examples of field emission cathode arrays and methods of making or using the same.

While field emission cathodes have many desirable attributes, in the past relatively convoluted and complex designs have been provided in efforts to shape and direct beams of electrons, protons or ions produced by the same. U.S. Pat. Nos. 4,103,202; 4,178,531; 4,020,381; and 4,498,952 are examples of such designs having added structure for these purposes.

SUMMARY OF THE INVENTION

The present invention relates to a particle field emission structure which provides initial automatic shaping of the beam of emitted particles, without requiring added shaping or other electrode structure nor design complexity. That is, it has been found that by appropriately selecting the electromagnetic interaction of the electrically conductive structures responsible for the emission of the desired particles, a potential field pattern can be established by those elements which otherwise are necessary for particle extraction to control the trajectory of the emitted particles. In other words, the desired beam shaping or other initial trajectory control is automatically provided by the very same elements which are responsible for the field emission, without the necessity of added electrodes or other structure. The potential field pattern responsible for the desired trajectory could be controlled by appropriately varying potential differences between such elements at different spatial locations. Such control also simply can be provided by appropriately selecting the relationship of the physical geometries of the two primary electrode structures, i.e., the base or control electrode as will be described.

In preferred specific embodiments of the invention, the base electrode provides a plurality of particle emitting tips arranged in an array of spaced-apart emission sites and has a generally continuous and planer surface between the emission sites, and the control electrode includes annular sections circumscribing each of the sites with a linear conduction section extending between adjacent sites. As will become apparent from the following more detailed description, this construction assures desired beam shaping, is simple to manufacture, reduces the capacitance between the base and control electrode structures, and facilitates isolation of failed emission sites from operation sites. It also can be constructed by simple etching using standard photolithography techniques.

BRIEF DESCRIPTION OF THE DRAWINGS

A more detailed description of the invention in conjunction with a description of preferred particle emission structure incorporating the same, follows with reference to the accompanying drawings in which.

DETAILED DESCRIPTION

Figure 1:
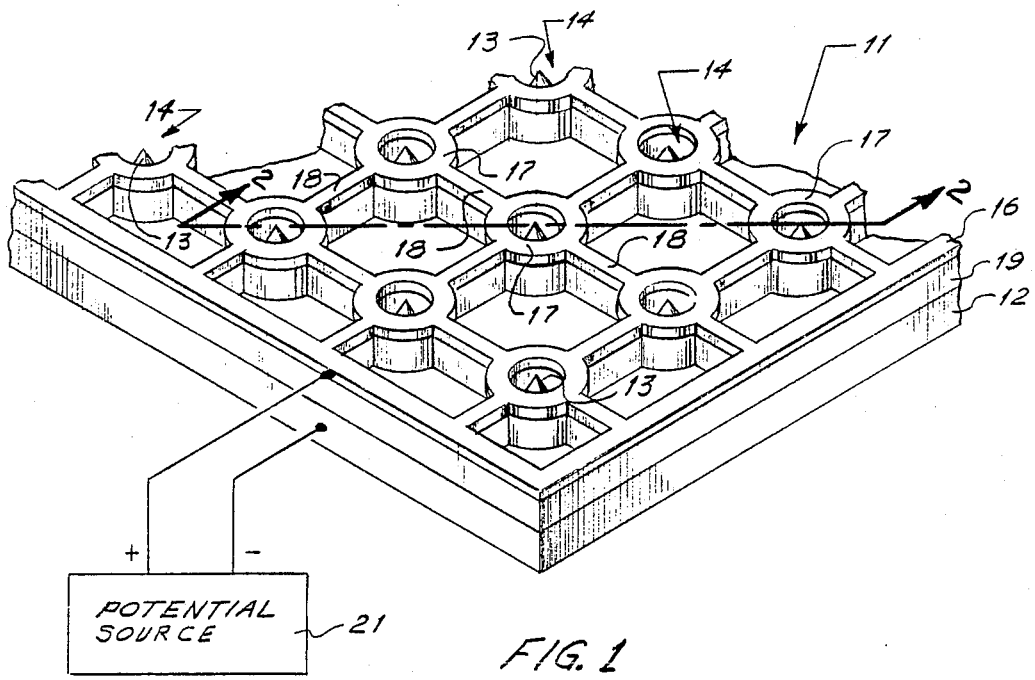
FIG. 1 is an enlarged, broken perspective view illustrating a preferred particle field emission structure of the invention.
Figure 2:
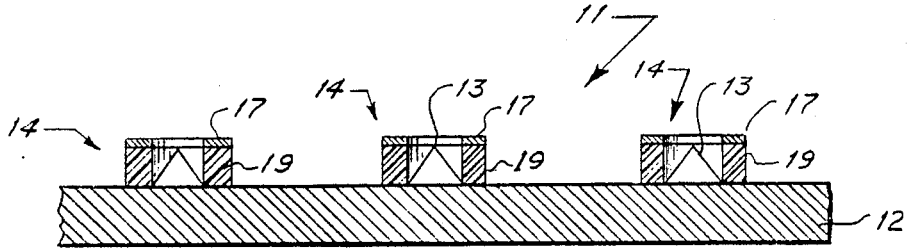
FIG. 2 is a partial sectional view of the structure of FIG. 1, taking on a plane indicated by the lines 2—2 in FIG. 1.
Figure 3:
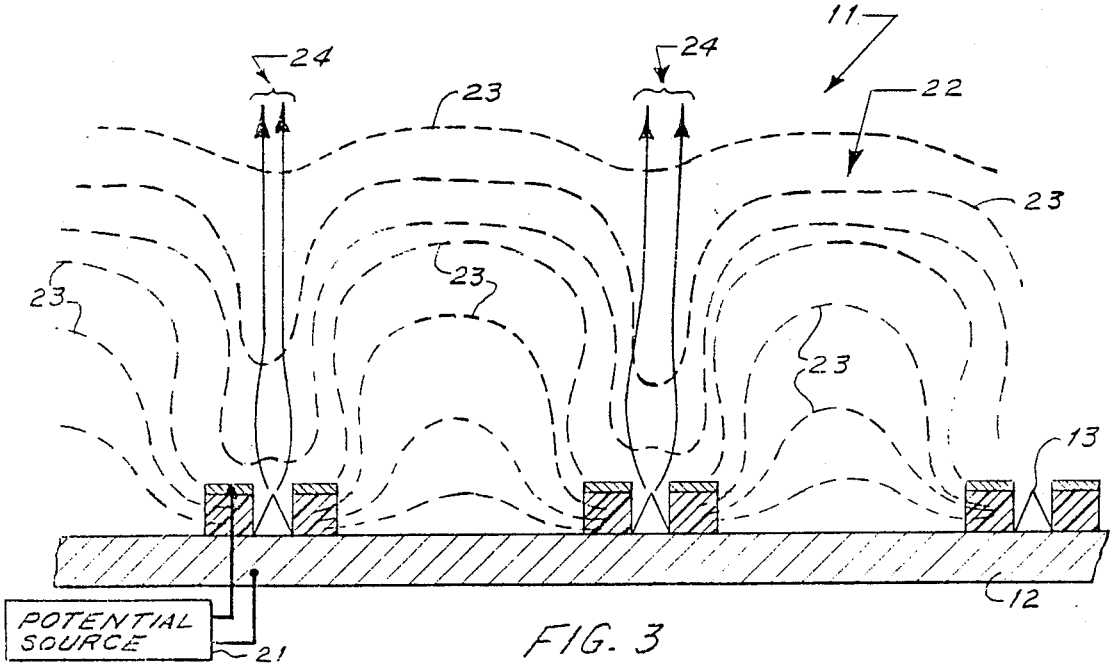
FIG. 3 is a schematic sectional view similar to FIG. 2 illustrating a potential field pattern established by the preferred embodiment of the invention, and the resulting trajectory of electrons emitted from the structure.

A field emission cathode array incorporating the invention is generally referred to in FIGS. 1, 2, and 3 by the reference numeral 11. Cathodes of this nature typically are associated with anodes which attract the electrons emitted thereby. The cathode of FIGS. 1–3 includes an electrically conductive base structure 12 from which electron emitting tips 13 project. While from the broad standpoint the emitting tips could be separate from the base structure, it is preferred and simpler to have the base structure and the tips an integral structure.

The tips 13 are arranged on the base structure to provide a plurality of spaced-apart particle emission sites 14. Although only one tip is illustrated at each emission site 14, it is within the contemplation of the invention to have a multitude of such tips at each of the sites. Moreover, base 12 structure provides both the necessary electrical conduction for the tips and the structural support for the same. It is recognized, though, that other structure could be included to provide the structural support. (For example, the base could be a thin film or the like on a supporting substrate.) While the base structure could be of a metal, it is preferred that it be a semiconductor silicon wafer substrate of the type used in the manufacture of integrated circuitry, doped to a resistivity of the order of 0.01 ohm-cm. As will become clearer from the description below relative to FIG. 5, higher resistivities may be used in certain circumstances to further enhance the beam shaping effect of the field.

An electrically conductive control electrode structure 16 is positioned to extract electrons from the tips 13. In keeping with the invention, control electrode structure 16 is made up of a plurality of annular sections or rings 17, each of which circumscribes an associated one of the emission sites, connected together by linear sections 18. As illustrated, the linear sections extend between adjacent annular sections and provide electrical conduction therebetween. Such control structure can be of a metal compatible with the vacuum within which the structure is located, such as, for example, molybdenum or chromium.

The region between adjacent emission sites is otherwise free of control electrode structure. The result is that at such locations the structure does not shield the spatial volume above the same, i.e., the volume opposite that containing the base, from the electric potential on the base.

Sandwiched between the base and control electrode structures is insulating material 19. Material 19 can be, for example, silicon dioxide deposited on the substrate as a thin layer in the manner discussed below. The control electrode structure then simply can be a thin metal film of molybdenum deposited on the layer of insulating material 19. Both the layer of insulating material and the film of metal then can be etched as discussed below to assure that the regions between adjacent emission sites are generally free of both. That is, in order to achieve the desired field pattern with the structure being described it is desirable that only the lead connection sections with suitable insulation from the base be provided in the regions between adjacent emission sites to provide paths to conduct electrical energy between the rings 17. The layer of insulating material is removed by etching along with the metal film between adjacent emission sites to reduce its surface area to inhibit buildup of surface charge which may interfere with establishing and maintaining the desired potential field pattern.

A source of potential is represented at 21. As illustrated, leads from the same extend to the base structure 12 and control electrode structure 16 to represent establishment of the potential difference required to cause flow of negatively charged particles from the sites 14 (reversing the applied potential will produce positively charged particles).

As mentioned previously, with the geometrical relationship illustrated between the base and electrode structures, the potential on the base structure will provide a desired potential field pattern above the cathode tip structure to shape into generally parallel beams, particles which emanate from the sites. This is in addition to providing the potential required for emission. Such field pattern, generally denoted by the reference numeral 22 in FIG. 3, is represented in such FIG. by equipotential lines 23. As shown, the pattern is established by the potential on the base structure except in those areas at which the control electrode structure interferes with the same. Since such control electrode structure is primarily made up of annular sections 17 which circumscribe each of the emission sites, the potential at the location of the emission sites on the base will be shielded by the sections 17, and the potential pattern above the cathode will have "troughs" at the emission sites as illustrated. In the arrangement being described, the lines 23 represent a retarding field relative to the particles which are extracted, with the result that the particles emanating from each of the sites are turned toward a line perpendicular to the control electrode surface. That is, whereas in a conventional arrangement because the control electrode structure extends generally continuously between the emission sites a generally uniform potential field pattern is established with the result emitted electrons flare away from one another due to angle of launch and mutual repulsion, with the structure of the invention extracted electrons are preferentially repelled by the field toward a line parallel to the axes of the tips 13 to form the beams 24. The structure can be optimized to provide desired shaping for a set emission level or angle of emission by modelling the same to determine the best width of the control electrodes for the given conditions.

It should be noted that While the linear sections 18 of the control electrode will cause some perturbations in the field pattern 22, these perturbations can be made small enough to not significantly affect the desired formation of the beams 24.

While in general the simplest implementation of the invention is in focusing emitted electrons into parallel beams, different desired trajectories for emitted particles can be achieved by different geometries. Moreover, factors other than geometry which affect the potential interaction between the control and base electrodes can be varied. For example, variations in the uniformity of the potential difference, applied between the base and control electrode structure, can be used to control the trajectory of emitted particles.

The cathode 11 is quite simply constructed. That is, a layer of insulating material 19 is applied to a base 12 and a continuous control electrode is formed over the whole surface. Photo or electron lithography is then used to pattern holes where tips are to be formed by the process described in U.S. Pat. Nos. 3,789,471 and 3,812,559. It is then a simple matter to form the control electrode and the insulating material into the desired geometry with conventional photoresist and etchants via lithography techniques.

Figure 4:
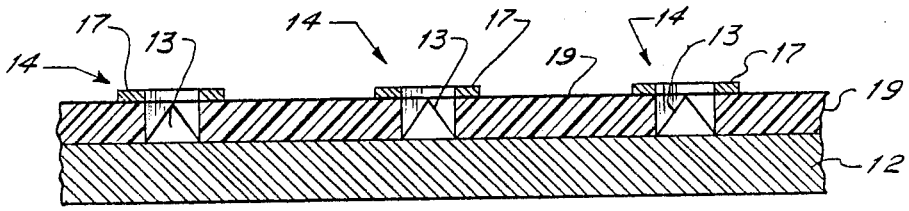
FIG. 4 is an enlarged, partial sectional view similar to FIG. 2 of a second preferred embodiment of the invention.

In those instances in which space charge effects caused by exposed insulating material surfaces in regions between emission sites is not a problem, it is not necessary to etch or otherwise remove the insulating material from the base structure. FIG. 4 is included simply to illustrate the structure which results when the insulating material is not removed. The embodiment of such figure is in all other respects the same as that described earlier, and the same reference numerals are used to identify the parts.

Figure 5:
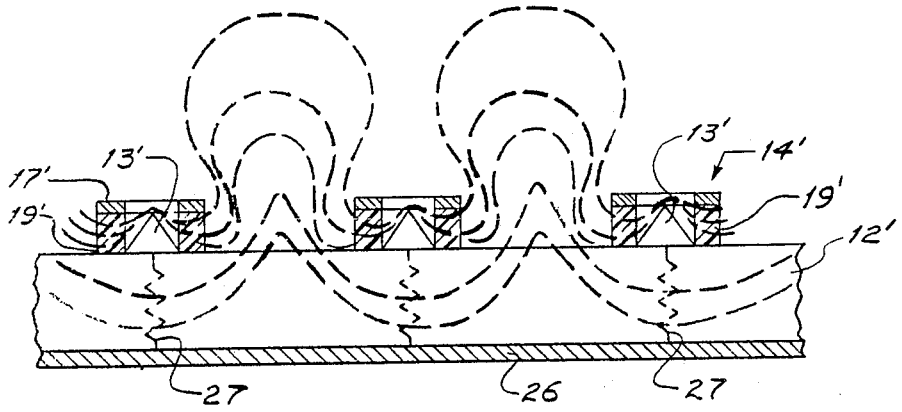
FIG. 5 is another enlarged, partial sectional view of a third preferred embodiment of the invention.

As mentioned previously, the effects of the invention can be achieved by appropriately varying potential differences between the control and base electrodes at difference spatial locations. FIG. 5 illustrates an embodiment of the invention at which such distribution of potential differences is achieved. The embodiment of the invention of FIG. 5 takes advantage both of this distribution of potential difference and the geometrical relationship of the earlier described embodiments without the necessity of requiring different potentials to be applied either to the base or to the control structures. It also provides an enhanced influence of the base field on the trajectory of emitted electrons. With reference to such figure, the base structure, referred to by the reference numeral 12', is a semiconductive material which is doped to, in essence, become conductive with high resistivity. It could be, for example, silicon which is doped with a conductive material to be a P type material having a resistivity of 500 ohm-cm. A continuous, conductive base plane 26 is also included to enable a desired potential to be applied to the base throughout its surface area opposite that from which the tips 13' project.

This embodiment is otherwise similar to the previously described embodiments and primed reference numerals are used to identify corresponding parts.

When current is drawn from the emitter tips 13' there will be a voltage gradient established in the base 12' that is determined by the resistance associated with the base silicon and the amount of current drawn from such emitter tips. The electrostatic field in the volume above the control electrodes is thereby enhanced, because the potential of the surface of the silicon between the emitter tips is more negative than the surface of the silicon directly under the tips. This effect is an automatic consequence of the current drawn through the silicon base as a result of the emission process. It is as though there is a resistor in series with each emitter tip that causes each tip to become more electrically positive as the emission from that tip is increased. The resistance of the base structure between the tips remains essentially the same, with the result that we have a distributed resistance in the base and there will be a radial field gradient emanating from the base of each tip as shown in FIG. 5. This field is the direct consequence of the emission current flowing through the silicon base and increases automatically with increased emission. The imaginary resistor for each emitter tip is represented in the figure at 27.

It is to be noted that the equipotential lines penetrate the base 12'. Moreover, the series resistance at each of the tips acts as a buffering resistance that protects each emitter tip 13 from experiencing a damaging over-current burst in the event of a sudden change in surface condition of the tip due to desorption of surface contaminants or the like.

It should be noted that the resistivity of the silicon base can be designed to optimize the trajectories for a given emission level, and that the effect is somewhat self compensating in that increased emission tends to produce increased angular spread; however, increased emission also causes the exposed silicon base between tips to be more negative than the tips, thereby increasing the strength of the fields that are tending to straighten the particle trajectories.

It will be appreciated from the above that the invention provides automatic focusing without the necessity of additional focusing structure. It does so simply by controlling the interaction between the base and control electrodes responsible for the emission of particles. Thus, the invention represents a significant advance in the field emission cathode art. While it has been described in detail in connection with preferred embodiments thereof, those skilled in the art will recognize that various changes and modifications can be made without departing from its spirit. It is therefore intended that the coverage afforded applicant be defined by the following claims.

I claim:

1. A particle field emission structure comprising, in combination: at least one particle emission site having one or more emitting tips for electrically charged particles; an electrically conductive base structure positioned to provide electrical energy to said emitting tips for electrically charged particles to be emitted therefrom; an electrically conductive control electrode structure positioned at said site for controlling the extraction of particles from said site; means for applying a potential difference between said base structure and said control electrode to extract electrically charged particles from said particle emission site; said control electrode, base structure, and potential applying means being selected to have an electromagnetic interaction between said control electrode and said base structure providing both an extraction potential for said particles and automatically establishing a potential field pattern in the spatial volume adjacent said control electrode structure on the side thereof opposite said base structure which will provide desired trajectories therethrough of particles formed at said site.

2. The particle field emission structure of claim 1 wherein said electrically conductive base structure is integral with said emission site, and said one or more electrically charged particle emitting tips project from said base structure.

3. The particle field emission structure of claim 1 wherein said tips are electron emitting tips and said particles to be extracted therefrom are electrons.

4. The particle field emission structure of claim 1 wherein said potential difference between said base structure and control electrode is varied relative to the spatial location of said electrodes to one another.

5. The particle field emission structure of claim 1 wherein there are a plurality of said particle emission sites spaced apart from one another and said control electrode and base structures have geometrical shapes between said sites which are related to one another so as to establish said potential field pattern.

6. The particle field emission structure of claim 5 wherein said potential difference between said base structure and control electrode is varied relative to the spatial location of said electrodes to one another.

7. The particle field emission structure of claim 5 wherein said geometrical shapes are selected to have a relationship to direct particles emitted from said sites into said volume, into generally non-diverging beams.

8. The particle field emission structure of claim 6 wherein said electrically conductive base has a generally continuous and planar surface between said emission sites and the electrode structure includes generally annular sections for said sites, each of which circumscribes an associated one of said sites, and a generally linear conduction sections extending between adjacent annular sections, the region between adjacent emission sites otherwise being free of control electrode structure whereby potential on said control structure generally does not interfere with potential on said base defining said potential field pattern in said region.

9. The particle field emission structure of any of the previous claims, further including an electrical insulator structure at each of said sites between said electrically conductive base and said control electrode structure.

10. A method of generating electrically charged particles and controlling the initial trajectory thereof, comprising the steps of:

A. Providing at least one particle emission site having one or more electrically charged particle emitting tips;

B. Providing an electrically conductive base structure positioned to provide electrical energy to said emitting tips for electrically charged particles to be emitted therefrom;

C. Providing an electrically conductive control electrode structure at said site for controlling the extraction of particles from the emitting tips thereat; and D. Controlling a potential difference between said base structure and said control electrode to extract electrically charged particles from said particle emission site and to automatically establish a potential field pattern which will interact with electrically charged particles in the spatial volume adjacent said control electrode structure on the side thereof opposite said base by selecting a desired electromagnetic interaction between said base and control electrode structures during the extraction of particles from said site.

11. The method of claim 10 wherein said step of controlling the potential field pattern which will interact with charged particles produced at each of said sites includes providing a preselected geometrical relationship between said base structure and said control electrode structure adjacent said site.

12. The method of claim 11 wherein said step of controlling the potential field pattern which will interact with charged particles produced at each of said sites includes distributing the potential differences between said base structure and said control electrode structure.

13. The method of claim 10 wherein said steps of providing at least one charged particle emission site and providing an electrically conductive base structure comprises the step of providing an electrically conductive base structure having one or more electrically charged particle emission tips extending integrally therefrom to define said emission site.

14. The method of claim 13 wherein said step of providing a base structure includes providing an electrically conductive base structure defining a plurality of spaced-apart charged particle emission sites, each of which includes one or more of said emitting tips integral with said base structure; wherein said step of providing a control electrode structure at said site includes providing such a structure for each of said sites; and said step of controlling the potential field pattern in said spatial volume includes selecting a desired electromagnetic interaction between said base and control electrode structure at and adjacent said plurality of sites during the extraction of particles from the same.

15. The method of claim 14 wherein said step of providing an electrically conductive control electrode structure for each of said sites includes providing a common control electrode for said sites having generally annular sections, each of which circumscribes an associated one of said sites, and generally linear connection sections providing conductive paths connecting said plurality of annular sections.

16. The method of claim 14 wherein said step of controlling the potential field pattern which will interact with electrically charged particles produced at each of said sites includes maintaining said base substantially free of shielding by said control electrode structure in the regions between said spaced-apart sites.

17. The method of any of the previous claims 10 through 16 wherein each of said spaced-apart particle emission sites are electron emission sites.

18. A method of constructing a particle field emission structure which comprises the steps of:

A. applying a layer of insulating material on one surface of a base structure;

B. applying a generally continuous and planar layer of electrically conductive material on said insulating material with a plurality of spaced-apart apertures through said layers;

C. forming electrically charged particle emission sites at said apertures; and thereafter D. removing substantially all of said layer of electrically conductive material between said sites to form a control electrode structure for electromagnetic interaction with said base structure to extract particles from said emission sites while enabling potential on said base structure to aid the formation of a potential field pattern in the spatial volume on the side of said control electrode structure opposite said base structure which will provide desired trajectories therethrough of particles formed at said sites.

19. The method of claim 18 of constructing a field emission cathode wherein said step of removing includes leaving between said sites, lead sections of said electrically conductive material to provide the electrically conductive paths necessary for common energization of a plurality of said sites.

20. The method of claim 18 wherein said step of removing substantially all of said layer of electrically conductive material includes etching said material from said insulating material in a preselected pattern.

21. The method of claim 1 wherein said insulating material is applied as a layer on said surface of said base structure, and further including the step of removing substantially all of said layer of insulating material between said particle emission sites.

* * * * *